US008199949B2

(12) United States Patent
Fischer et al.

(10) Patent No.: US 8,199,949 B2
(45) Date of Patent: Jun. 12, 2012

(54) PROCESSING AN INPUT SIGNAL IN A HEARING AID

(75) Inventors: Eghart Fischer, Schwabach (DE); Matthias Fröhlich, Erlangen (DE); Jens Hain, Kleinsendelbach (DE); Henning Puder, Erlangen (DE); André Steinbuβ, Erlangen (DE)

(73) Assignee: Siemens Audiologische Technik GmbH, Erlanger (DE)

( * ) Notice: Subject to any disclaimer, the term of this patent is extended or adjusted under 35 U.S.C. 154(b) by 1247 days.

(21) Appl. No.: 11/973,475

(22) Filed: Oct. 9, 2007

(65) Prior Publication Data

US 2008/0130925 A1 Jun. 5, 2008

(30) Foreign Application Priority Data

Oct. 10, 2006 (DE) ..... 10 2006 047 986

(51) Int. Cl.
*H04R 25/00* (2006.01)

(52) U.S. Cl. ..... 381/318; 381/313

(58) Field of Classification Search ..... None
See application file for complete search history.

(56) References Cited

U.S. PATENT DOCUMENTS

| | | | | |
|---|---|---|---|---|
| 6,243,476 | B1 | 6/2001 | Gardner | |
| 6,704,369 | B1 | 3/2004 | Kawasaki et al. | |
| 2002/0037087 | A1 * | 3/2002 | Allegro et al. | 381/317 |
| 2004/0175008 | A1 * | 9/2004 | Roeck et al. | 381/312 |
| 2006/0120535 | A1 * | 6/2006 | Puder | 381/26 |
| 2008/0130925 | A1 * | 6/2008 | Fischer et al. | 381/317 |

FOREIGN PATENT DOCUMENTS

| | | | |
|---|---|---|---|
| CN | 1578542 | A | 1/2005 |
| DE | 19652336 | A1 | 6/1998 |
| EP | 1 017 253 | A2 | 7/2000 |
| EP | 1496680 | A1 | 1/2005 |
| EP | 1 655 998 | A2 | 5/2006 |
| EP | 1670285 | A2 | 6/2006 |
| WO | 2004114722 | A1 | 12/2004 |

OTHER PUBLICATIONS

M. Büchler, N. Dillier, S. Allegro and S. Launer, Proc. DAGA, 2000, pp. 282-283.

Communication/Office Action from Chinese Patent Office, Jul. 22, 2011, pp. 1-14.

* cited by examiner

*Primary Examiner* — Hoang-Quan Ho

(57) ABSTRACT

A method for processing at least one first and one second input signal in a hearing aid, with the input signals being filtered to create intermediate signals, the intermediate signals being added to form output signals, the input signals being assigned to a defined signal situation, and with the signals being filtered as a function of the assigned defined signal situation.

5 Claims, 4 Drawing Sheets

PROCESSING AN INPUT SIGNAL IN A HEARING AID

CROSS REFERENCE TO RELATED APPLICATIONS

This application claims priority of German application No. 102006047986.6 DE filed Oct. 10, 2006, which is incorporated by reference herein in its entirety.

FIELD OF INVENTION

The invention relates to a method for processing an input signal in a hearing aid, as well as to a device for processing an input signal in a hearing aid

BACKGROUND OF INVENTION

The enormous progress in microelectronics now allows comprehensive analog and digital signal processing even in the smallest space. The availability of analog and digital signal processors with minimal spatial dimensions has also smoothed the path in recent years to allow their use in hearing devices, obviously an area of use in which the system size is significantly restricted.

A simple amplification of an input signal by a microphone often leads for the user to an unsatisfactory hearing aid, since noise signals are also amplified and the benefit for the user is restricted to specific acoustic situations. Digital signal processors have been built into hearing aids for a number of years now, said processors digitally processing the signal of one or more microphones in order for example to explicitly suppress interference noise.

The implementation of Blind Source Separation (BSS) is known in hearing aids to assign components of an input signal to different sources and to generate corresponding individual signals. For example a BSS system can split up the input signal of two microphones into two individual signals, of which one can then be selected and then be output to a user of the hearing aid, under some circumstances after an amplification or after further processing, via a loudspeaker.

Another known method is to undertake a classification of the actual acoustic situation, in which the input signals are analyzed and characterized in order to differentiate between different situations, which can be related to model situations of daily life. The situation established can then for example determine the selection of the individual signals which are provided to the user.

Thus for example in M. Büchler and N. Dillier, S. Allegro and S. Launer, Proc. DAGA, pages 282-283 (2000), a classification of an acoustic environment for hearing device applications is described in which on of the classification variable used is an averaged signal level.

SUMMARY OF INVENTION

In reality however a plurality of possible acoustic situations can result in an inappropriate classification and thereby also to a disadvantageous selection of the signals perceptible to the user. Conventional hearing aids can thus only provide the user with an unsatisfactory result in particular acoustic situations and can require manual intervention to correct the classification or the signal selection. In especially disadvantageous situations even important sound sources can remain hidden to the user since because of an incorrect selection or classification they are only output in attenuated form or are not output at all.

The object of the present invention is thus to provide an improved method for processing an input signal in a hearing device. It is further an object of the present invention to provide an improved device for processing an input signal in a hearing device.

These objects are achieved by the independent claims. Further advantageous embodiments of the invention are specified in the dependent claims.

In accordance with a first aspect of the present invention a method is provided for processing at least one first and one second input signal in a hearing aid. In this method the first input signal is filtered to create a first intermediate signal with at least one first coefficient, the first input signal is filtered to create a second intermediate signal with at least one second coefficient, the second input signal is filtered to create a third intermediate signal with at least one third coefficient and the second input signal for is filtered to create a fourth intermediate signal with at least one fourth coefficient. The first and the third intermediate signal are added to create a first output signal and the second intermediate signal and the fourth intermediate signal are added to create a second output signal. The first and the second input signal are assigned to a defined signal situation and at least one of the coefficients is changed as a function of the assigned defined signal situation. In accordance with the present invention a coefficient can be scalar or also multi-dimensional, such as a coefficient vector or set of coefficients with a number of scalar components for example.

In accordance with a second aspect of the present invention a device is provided for processing at least one first and one second input signal in a hearing aid, with the device comprising a first filter for filtering the first input signal and for creating a first intermediate signal, a second filter for filtering the second input signal and for creating a second intermediate signal, a third filter for filtering the third input signal and for creating a third intermediate signal, a fourth filter for filtering the fourth input signal and for creating a fourth intermediate signal, a first summation unit for addition of the first intermediate signal and the third intermediate signal and for creating a first output signal, a second summation unit for addition of the second intermediate signal and the fourth intermediate signal and for creating a second output signal and a classification unit which assigns the first input signal and the second input signal to a defined signal situation and changes at least one of the filters as a function of the assigned defined signal situation.

There is advantageous provision in accordance with of the present invention for changing at least one filter or the corresponding coefficient as a function of a defined signal situation. This enables the processing of the first and of the second input signal to be adapted to different signal situations. The first output signal and the second output signal can thus, depending on different signal situations, still have common components. A user of the hearing aid can thus for example also continue to be provided with important signal components and the acoustic existence of different sources is not hidden to the user. The input signal can in this case originate from one or more sources and it is possible to explicitly output corresponding components of the input signal or to output them explicitly attenuated. In this case acoustic signal components from specific sources can be explicitly let through, whereas acoustic signal components of other sources can be explicitly attenuated or suppressed. This is conceivable in a plurality of real-life situations in which a corresponding passage or attenuated passage of signal components is of advantage for user.

In accordance with one embodiment of the present invention, to assign the input signals to a defined signal situation, at least one of the classification variables number of signal components, level of a signal component, distribution of the level of the signal components, power density spectrum of a signal component, level of an input signal and/or a spatial position of the source of one of the signal components is determined. The input signals can then be assigned as a function of at least one of the enumerated classification variables to a defined signal situation. The defined signal situations can in this case be predetermined, stored in the hearing aid or able to be changed or updated. The defined signal situations advantageously correspond to normal real-life situations which can be characterized and organized by the above mentioned classification variables or also by other suitable classification variables In accordance with a further embodiment of the present invention a maximum correlation of the first output signal and the second output signal is defined depending on the assigned defined signal situation and at least one of the coefficients or filters is changed as a function of the correlation, until correlation corresponds to the maximum correlation. This means that in an advantageous manner the separation power or the correlation between the first output signal and the second output signal can be adapted to the actual acoustic situation. Accordingly there can be provision in a defined signal situation to maximize the separation power, i.e. to let the maximum correlation approach zero in order in this way to minimize the correlation of the first output signal and of the second output signal. In another acoustic situation by contrast there can be provision for restricting a maximum correlation to for example 0.2 or 0.5. Thus the correlation of the first output signal and the second output signal can amount to up to 0.2 or 0.5. This means that the first output signal and the second output signal contain up to a certain proportion of signal components which can then, even if only one of the output signals is selected, be provided to the user in any event and advantageously do not remain hidden to the latter.

BRIEF DESCRIPTION OF THE DRAWINGS

Preferred embodiments of the present invention will be explained in greater detail below with reference to the enclosed drawings. The figures show.

DETAILED DESCRIPTION OF INVENTION

Figure 1:
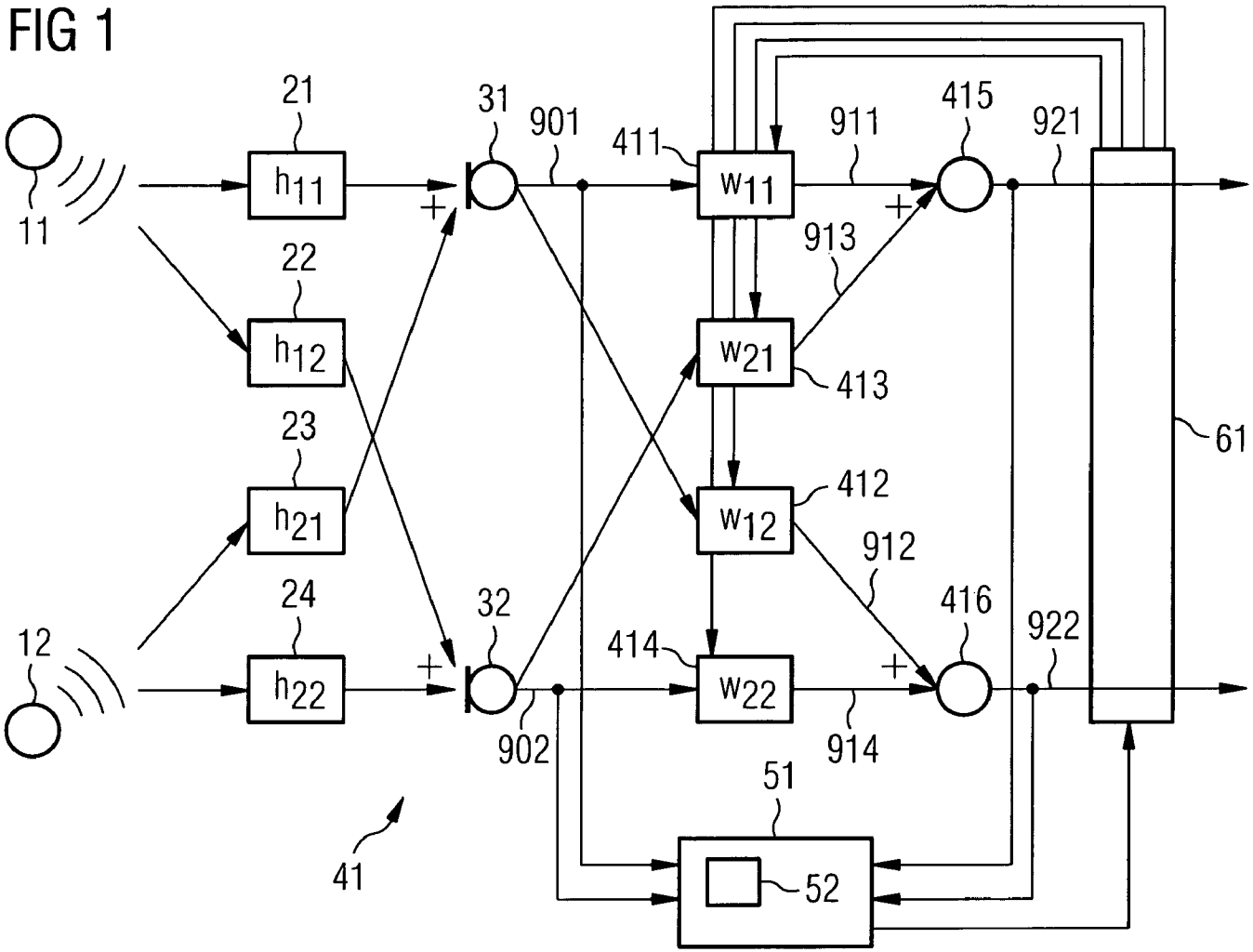
FIG. 1 a schematic diagram of a first processing unit in accordance with a first embodiment of the present invention.

FIG. 1 shows a schematic diagram of a first processing unit 41 in accordance with a first embodiment of the present invention. A first source 11 and a second source 12 send out acoustic signals which arrive at a first microphone 31 and a second microphone 32. The acoustic environment, for example comprising attenuating units or also reflecting walls, are represented here as models by a first environment filter 21, a second environment filter 22, a third environment filter 23 and a fourth environment filter 24. The first microphone 31 generates a first input signal 901 and the second microphone 32 generates a second input signal 902.

The first input signal 901 is made available to a first filter 411 and to a second filter 412. The second input signal 902 is made available to a third filter 413 and to a fourth filter 414. The first filter 411 filters the first input signal 901 to create a first intermediate signal 911. The second filter 412 filters the first input signal 901 to create a second intermediate signal 912. The third filter 413 filters the second input signal and 902 to create a third intermediate signal 913. The fourth filter 414 filters the second input signal 902 to create a fourth intermediate signal 914.

The first intermediate signal 911 and the third intermediate signal 913 are added by a first summation unit 415 to form a first output signal 921. The second intermediate signal 912 and the fourth intermediate signal 914 are added by a second summation unit 416 to form a second output signal 922. The first output signal 921 and the second output signal 922 are made available to a correlation unit 61 which determines the correlation between the first output signal 921 and the second output signal 922.

The first input signal 901 and the second input signal 902 are also made available to a classification unit. Optionally there can be provision for the first output signal and 921 and/or the second output signal 922 to also being made available to the classification unit 51. The classification unit 51 can further feature a memory unit 52 in which defined signal situations are stored. The classification unit 51 assigns the input signals 901, 902 and where necessary the output signals 921, 922 to a defined signal situation. To this end the classification unit 51 can determine at least one of the classification variables number of signal components, level of a signal component, distribution of the level of the signal components, power density spectrum of a signal component and/or level of a signal component and the assignment to a defined signal situation can be undertaken as a function of at least one of the classification variables.

A signal component can be one of a number of components of an input signal 901, 902 which inherently originates from a source or from a group of sources. Signal components can be separated for example if input signals with acoustic signal components of a source from at least two microphones are present. These signal components can in this case exhibit a corresponding time delay or can exhibit other differences which can also be included for determining a spatial position. The input signals 901, 902 then feature two equivalent sound components which are offset by a specific time interval. This specific time interval is produced by the sound of one source 11, 12 in general reaching the first microphone 31 and the second microphone 32 at different points in time. For example, for the arrangement shown in FIG. 1, the sound of the first source 11 reaches the first microphone 31 before the second microphone 32. The spatial distance between the first microphone 31 and the second microphone 32 likewise influences the specific time interval in this case. In modern hearing aids this distance between the two microphones 31, 32 can be reduced to just a few millimeters, in which case a reliable separation is still possible.

In order to determine a most similarly defined signal situation a classification variable determined does not absolutely have to be identical to a classification variable of the defined signal situation, but the classification unit 51 can for example, by providing bandwidths and tolerances in the classification variables, assign one of the defined signal situations which is most similar. As well as the classification variables and the corresponding tolerances, in a defined signal situation a scheme for controlling the filter or the corresponding coefficient respectively is stored. If the classification unit 51 has thus assigned the actual acoustic situation of the source to a defined signal situation, the correlation unit 61 is instructed accordingly by a control signal to minimize the correlation between the first output signal 921 and the second output signal 922 or to restrict it to a specific limit value.

For possible signal situations which are to be tailored to situations of everyday life and examples of corresponding classification variables the reader is referred to the following table, which shows possible signal situations, their classification variables and a corresponding scheme for changing the coefficients:

| Signal situation | Classification variables | Level change |
|---|---|---|
| Conversation in a quiet room | few signal components<br>few strong signal-components<br>few weak signal-components<br>high signal-to-noise ratio | lower separation power<br>correlation to 1 allowed |
| Conversation in the car | many signal components (reflections)<br>components with characteristic power-spectrum (motor) | medium separation power<br>correlation to 0.2 or 0.5 allowed |
| Cocktail party | many signal components<br>separation power<br>high level | high<br>minimize correlation |

Strong signal components can in this case be distinguished from a weak signal components for example on the basis of their relevant level. The level of a signal component is to be understood here as the average amplitude height of the corresponding acoustic signal, with a high average amplitude height corresponding to a high level and below average amplitude height to a low level. The strong components can in such cases exhibit an average amplitude height which is at least twice the height of that of a weak component. There can further also be provision for assigning an amplitude height of a strong component which is increased by 10 dB in relation to an amplitude height of a weak component. The level of a component is amplified or attenuated by the corresponding component being amplified or attenuated so that the averaged amplitude height is increased or reduced. A significant amplification or attenuation of a level cannot typically be achieved by increasing or reducing the corresponding average amplitude height by at least 5 dB. The correlation of the output signals in this case is a measure for common signal components of the output signals. A maximum correlation which is assigned a value of 1 means that both output signals are correlated to the maximum and are thus the same. A minimum correlation to which a value of 0 is allocated means that the two output signals have a minimum correlation and are thus not the same or do not have any common signal components.

In accordance with this embodiment of the present invention the first output signal 921 and the second output signal 922 have a correlation which can be controlled as a function of the actual acoustic situation or can be adapted to the latter. There can thus be provision for minimizing the correlation, i.e. maximizing the separation power, or also for restricting the separation power, i.e. allowing the correlation to rise as far as a given maximum value. This means that in an advantageous manner for example the first output signal 921 still features to a specific-well-defined restricted degree signal components of the second output signal 922. If for example the user of a hearing-aid is only provided with the first output signal 921 the acoustic existence of the sources of the corresponding signal components do not remain hidden to be user. It can be guaranteed in this way that the user of a hearing aid can also perceive the important sources although these are not a significant component of the actual acoustic current situation. Examples of such sources include intruding sources such as for example an overtaking car when driving a vehicle or a third party speaking suddenly during a conversation with a person opposite you.

Figure 2:
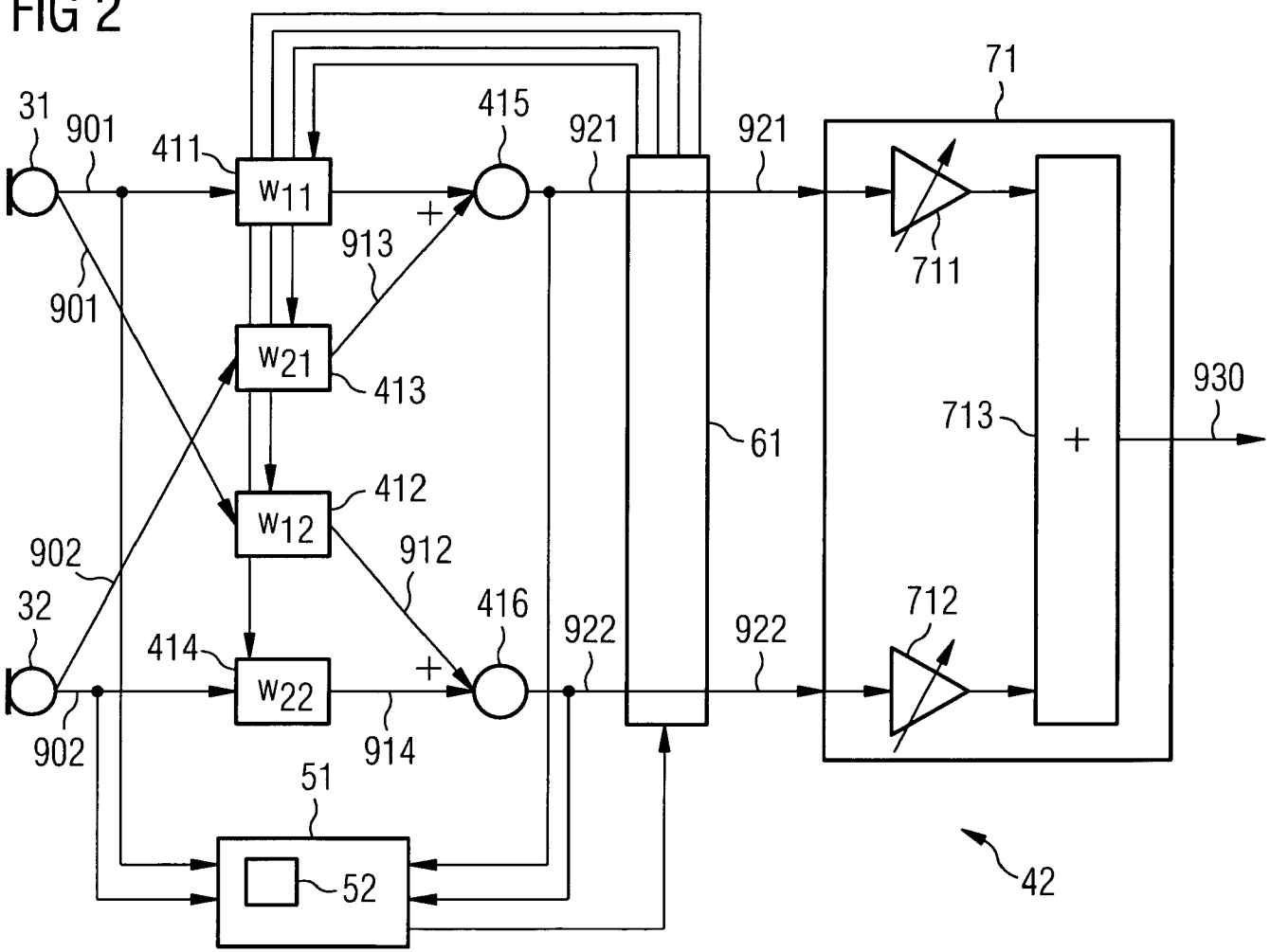
FIG. 2 a schematic diagram of a second processing unit in accordance with a second embodiment of the present invention.

FIG. 2 shows a second processing unit 42 in accordance with a second embodiment of the present invention. The second processing unit 42, in a similar manner to the first processing unit 41 which was described in conjunction with FIG. 1, contains filters 411, 412, 413 and 414, summation units 415 and 416, a classification unit 51 with a memory unit 52 and a correlation unit 61. The filters 411 to 414 and the classification unit 51 are again provided with the first input signal 901 from the first microphone 31 and the second input signal 902 from the second microphone 32. Optionally there can again be provision for making available to the first classification unit 51 the first output signal 921 and/or the second output signal 922. The correlation unit 61 controls the filters 411 through 414 depending on an acoustically-defined signal situation assigned to the classification unit 51.

In accordance with this embodiment of the present invention the first output signal 921 and the second output signal 922 will be made available to a mixer unit 71. There can be provision for this in the case of an ideal separating power. The mixing unit 71 features a first amplifier 711 for variable amplification or also attenuation of the first output signal 921 and a second amplifier for amplification or also variable attenuation of the second output signal 922. The attenuated or amplified output signals 921, 922 are made available to a summation unit 713 for generation of an output signal 930. In accordance with this embodiment of the present invention the first output signal 921 and the second output signal 922 can be overlaid again after the separation and thus made available jointly to a user.

Figure 3:
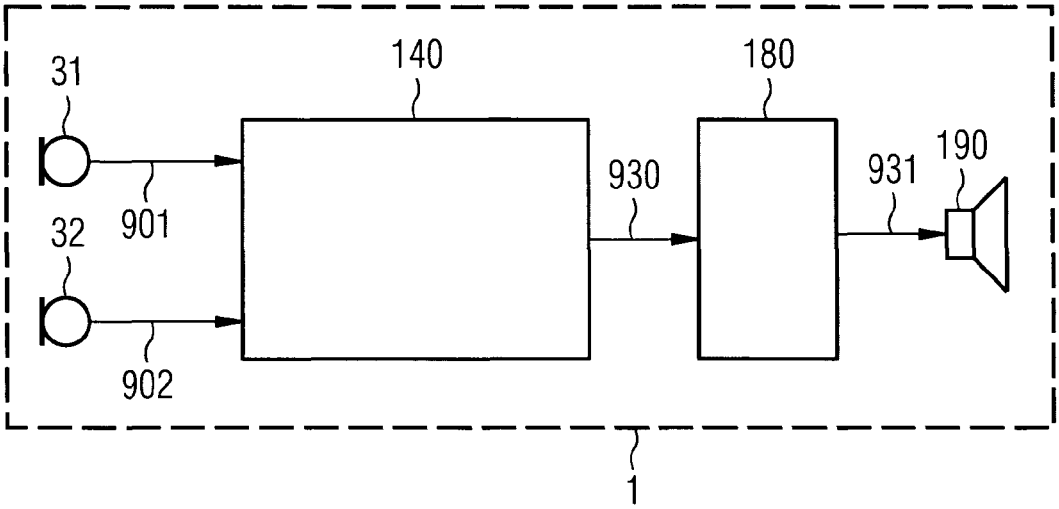
FIG. 3 a schematic diagram of a hearing aid in accordance with a third embodiment of the present invention.

FIG. 3 shows a hearing aid 1 in accordance with a third embodiment of the present invention. The hearing aid 1 features the first microphone 31 for generation of the first input signal 901 and the second microphone 32 for generation of the second input signal 902. The first input signal 901 and the second input signal 902 will be made available to a processing unit 140. The processing unit 140 can for example correspond to the first processing unit 41 or the second processing unit 42 which are described in conjunction with FIG. 1 or 2. In accordance with this embodiment of the present invention the output signal 930 is made available to an output unit 180 is provided for creation of a loudspeaker signal 931. The loudspeaker signal 931 will be made available via a loudspeaker 190 to the user.

By integration of the processing unit 140 into the hearing aid 1, the acoustic signals originating from different sources and picked up by the microphones 31, 32 can be made available to the user with a variable and situation-dependent separation power. The processing unit 140 assigns in accordance with this embodiment the actual acoustic situation which it receives via the microphones 31, 32 to a defined signal situation and accordingly regulates the separation power and/or selects one of the output signals. In an advantageous manner the output signal 930 includes all of the important signal components for the corresponding acoustic signal situation in appropriately amplified form while other signal components are provided suppressed or in accordance with the signal situation, in any event at least more attenuated. The hearing aid 1 can for example represent a hearing device which is worn behind the ear (BTE—Behind The Ear), can represent a hearing device which is worn in the ear (ITC—in The Ear, CIC—Completely in the Canal) or a hearing device in an external central housing with a connection to a loudspeaker in the acoustic vicinity of the ear.

Figure 4:
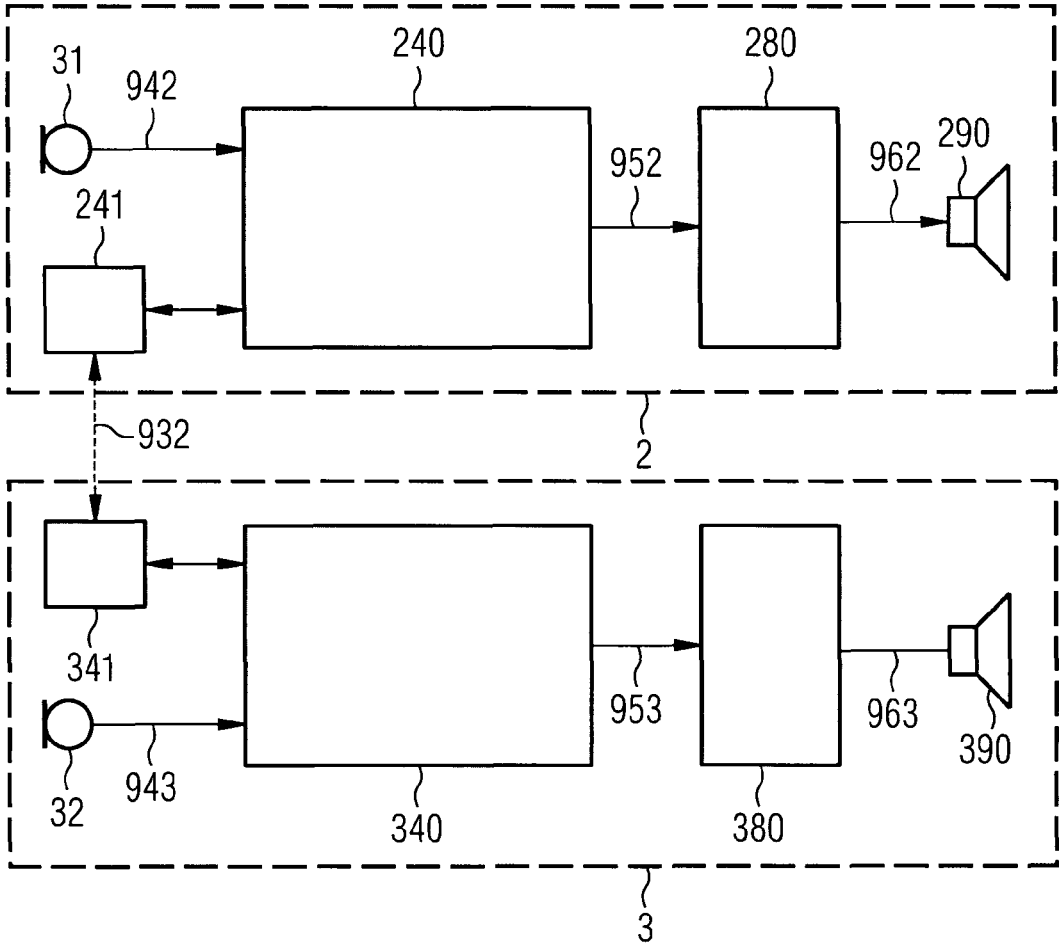
FIG. 4 a schematic diagram of a left-ear hearing aid and right-ear hearing aid in accordance with a fourth embodiment of the present invention.

FIG. 4 shows a schematic diagram of a left-ear hearing aid 2 and a right-ear hearing aid 3 in accordance with a fourth embodiment of the present invention. The left hearing device 2 in this case features at least the first microphone 31, a left processing unit 240, a left output unit 280, a left loudspeaker 290 and a left communication unit 241. The left input signal 942 generated by the first microphone 31 is made available to the left processing unit 240. The left processing unit 240 outputs a left output signal 952 depending on an assigned defined signal situation. The output unit 280 creates a left loudspeaker signal 962 which is acoustically output via the left loudspeaker 290. The left processing unit 240 can communicate via the left communication unit 241 and via a communication signal 232 with a further hearing device.

The right hearing device 3 in this case feature at least the second microphone 32, a right processing unit 340, a right output unit 380, a right loudspeaker 390 and a right communication unit 341. The right input signal 943 generated by the second microphone 32 will be made available to the right processing unit 340. The right processing unit 340 outputs a first right output signal 953 depending on an assigned defined signal situation. The output unit 380 creates a right loudspeaker signal 963 which is acoustically output the via the right loudspeaker 390. The right processing unit 340 can communicate via the right communication unit 341 and via the communication signal 932 with a further hearing device.

As shown here, there is provision for communication between the left hearing device 2 and the right hearing device 2 using a communication signal 932. The communication signal 932 can be transmitted via a cable connection also via a cordless radio connection between the left hearing device 2 and the right hearing device 3.

In accordance with this embodiment of the present invention the left input signal 942 generated by the first microphone 31 can also be provided to the right processing unit 340 via the left communication unit 241, the communication signal 932 and the right communication unit 341. Furthermore the right input signal 943 generated by the second microphone 32 can also be provided to the left processing unit 240 via the right communication unit 341, the communication signal 932 and the left communication unit 241. This makes it possible for both the left processing unit 240 and also the right processing unit 340 to carry out a source separation and a reliable classification although the left and right hearing device 2, 3 can only have one of the microphones 31, 32 in each case. The increased distance between the first microphone 31 and the second microphone 32 compared to a joint arrangement of a number of microphones in a hearing device can be favorable and advantageous for the source separation and/or classification.

Via the under some circumstances also bidirectional path right communication unit 341, communication signal 932 and left communication unit 241, communication between the left processing unit 240 and the right processing unit 340 can also be provided in respect of a common classification. This makes it possible to guarantee that the two hearing devices 2, 3 assign the actual acoustic situation of those sources to the same defined signal situation and disadvantageous incompatibilities are suppressed for the user.

There can further be provision for the left hearing device 2 and/or the right hearing device 3 to feature two or more microphones. It can thus be guaranteed that even on failure or if there is a fault in one of the hearing devices 2, 3 or the communication signal 932, a reliable function is guaranteed, i.e. a source separation and an assignment to the acoustic situation is still possible for the individual inherently operable hearing device.

Via controls which can be arranged on one of the hearing devices 3, 4 or also via a remote control it can furthermore be possible for the user to intervene both into the classification and also into the spatial selection of the individual signals. The defined signal situations can thus advantageously, during a learning phase for example be tailored to requirements and the acoustic situation in which the user actually finds himself.

Figure 5:
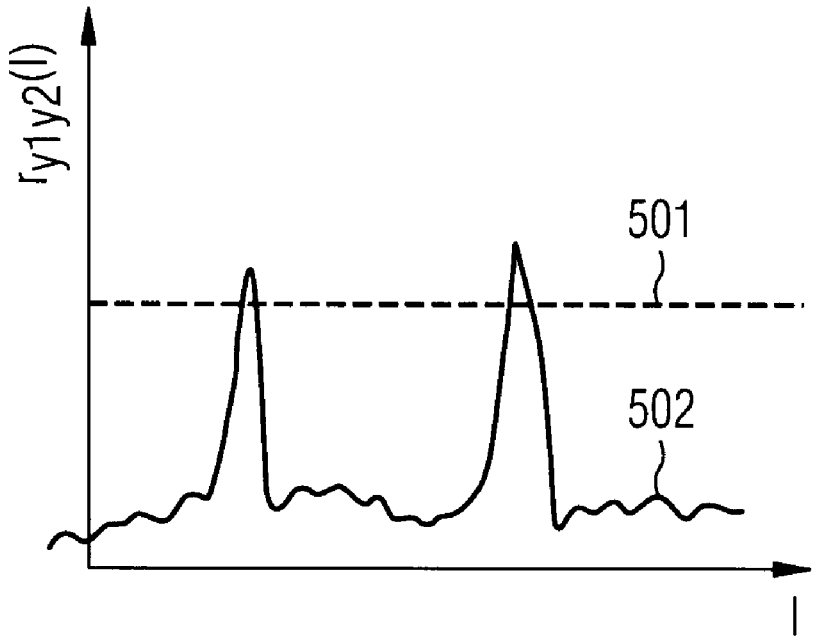
FIG. 5 a schematic diagram of a correlation in accordance with a fifth embodiment of the present invention and FIG. 6 a schematic diagram of a Fourier transformed in accordance with a sixth embodiment of the present invention.

FIG. 5 shows a cross-correlation $r_{12}(l)$ in accordance with a fifth embodiment of the present invention. The cross-correlation $r_{12}(l)$ in this case is a measure of the correlation. The cross-correlation $r_{12}(l)$, shown as a graph 502 in FIG. 5, is produced for two amplitude functions $y_1(l)$ and $y_2(l)$, for example the amplitude functions $y_1(l)$ of the first output signal and the amplitude functions $y_2(l)$ of the second output signal, in accordance with $$r_{12}(l)=E\{y_1(k)\times y_2(k+l)\}, \tag{1}$$

with E(X) being the expected value of the variable X is, k being a discretized time over which the expected value E(X) is determined and l being a discretized time delay between $y_1(k)$ and $y_2(k+l)$.

There can be provision in a source separation for changing at least one filter or a corresponding coefficient until such time as the cross correlation $r_{12}(l)$ in accordance with (1) is minimized for all l of an interval. A value of 0.1 can be assumed as a minimum value for example, since a minimization of $r_{12}(l)$ towards 0 is not always possible and above all is frequently not necessary. A high cross correlation $r_{12}(l)$ with a value towards 1 corresponds in this case to a low separation power where, as a disappearing cross correlation $r_{12}(l)$ towards 0 corresponds to a maximum separation power.

In accordance with this embodiment of the present invention a variable threshold value 501 is provided for the cross correlation $r_{12}(l)$. The threshold value can be changed as a function of a defined signal situation and thus for example assume a value of 0.2 or 0.5. The source separation by adaptation of the filter or of the coefficient is ended for example if the cost correlation $r_{12}(l)$ for all l of an interval lies below the threshold value 501. This advantageously guarantees that the two amplitude functions $y_1(l)$ and $y_2(l)$ or the corresponding signals still exhibit a minimum correlation depending on the situation.

Figure 6:
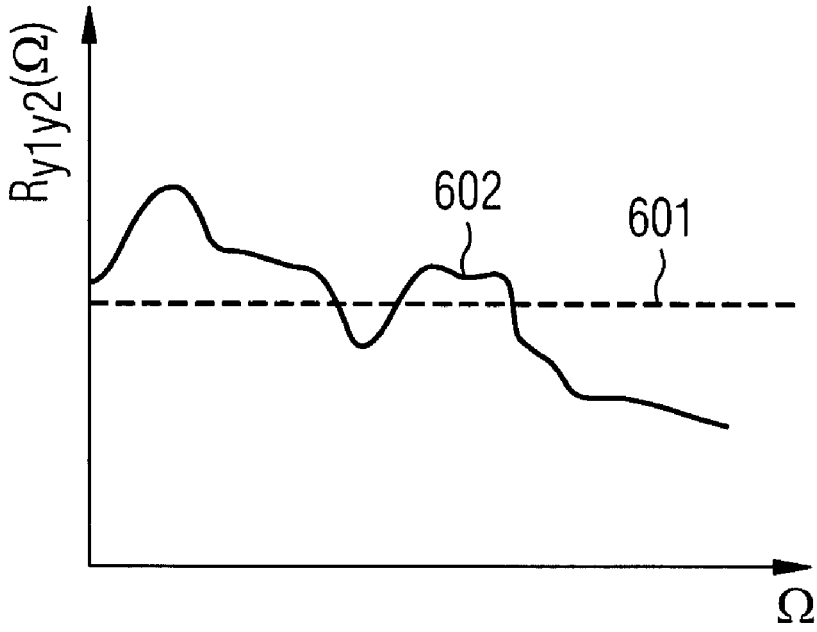

FIG. 6 shows a discrete Fourier transformed $R_{12}(\Omega)$ in accordance with a sixth embodiment of the present invention. A Fourier transformed $R_{12}(\Omega)$, shown in FIG. 6 as graph 602, is produced for example in the form of a discrete Fourier transformation (DFT) for the correlation $r_{12}(l)$ in accordance with (1) from $$R_{12}(\Omega)=\mathrm{DFT}\{r_{12}(l)\}. \tag{2}$$

In accordance with this embodiment the Fourier transformed $R_{12}(\Omega)$ will be determined for a frequency range and at least one filter or corresponding coefficient is changed until the Fourier transformed $R_{12}(\Omega)$ is minimized for a frequency range.

In accordance with this embodiment of the present invention a variable threshold value 601 is provided for the Fourier-transformed $R_{12}(\Omega)$. The threshold value can be changed as a function of a defined signal situation. The source separation by adaptation of the filter or of the coefficient is then ended for example if the Fourier-transformed $R_{12}(\Omega)$ lies in a frequency range below the threshold value 601. This advantageously guarantees that the two amplitude functions $y_1(l)$ and $y_2(l)$ or the corresponding signals still exhibit a minimum correlation depending on the situation.

In accordance with the present invention the first coefficient, the second coefficient the third coefficient and/or the fourth coefficient can be multi-dimensional. This means that the coefficients can be scalar or multi-dimensional, such as a coefficient vector, a coefficient matrix or a set of coefficients with a number of scalar components in each case.

The invention claimed is:

1. A method for processing a plurality of input signals in a hearing aid, the plurality of input signals including a first input signal and a second input, the method comprising:

filtering the first input signal with a first coefficient for creation of a first intermediate signal;

filtering the first input signal with a second coefficient for creation of a second intermediate signal;

filtering the second input signal with a third coefficient for creation of a third intermediate signal;

filtering the second input signal with a fourth coefficient for creation of a fourth intermediate signal;

adding the first intermediate signal and the third intermediate signal to form a first output signal adding the second intermediate signal and the fourth intermediate signal to form a second output signal;

assigning the first input signal and the second input signal to a defined signal situation;

changing at least one of the coefficients as a function of the assigned defined signal situation; and determining a correlation of the first output signal and of the second output signal; and changing at least one of the coefficients as a function of the correlation, wherein a maximum correlation is defined as a function of the assigned defined signal situation, and wherein the changing at least one of the coefficients being changed as a function of the correlation occurs until the correlation corresponds to the maximum correlation.

2. The method as claimed in claim 1, wherein the maximum correlation is smaller than 0.5.

3. The method as claimed in claim 1, wherein the first and second output signals are mixed to create an output signal for an acoustic output which is amplified.

4. The method as claimed in claim 1, wherein the assignment to the defined signal situation is as a function of at least one of the classification variables selected from the group consisting of number of individual signals, level of an individual signal, a distribution of a level of the individual signals, a power spectrum of an individual signal, and a level of the input signal.

5. The method as claimed in claim 1, wherein the defined signal situation is predetermined, and wherein the coefficients are multi-dimensional.

* * * * *